United States Patent [19]

Wilson

[11] 4,132,404

[45] Jan. 2, 1979

[54] LEG STRETCHING EXERCISE DEVICE

[76] Inventor: Raymond L. Wilson, 104C Briarridge Dr., Turtle Creek, Pa. 15145

[21] Appl. No.: 801,062

[22] Filed: May 27, 1977

[51] Int. Cl.[2] ..... A63B 21/00

[52] U.S. Cl. ..... 272/109; 272/127; 272/146

[58] Field of Search ..... 272/127, 135, 139, 142, 272/143, DIG. 4; 280/87.01, 87.04 R, 134; 270/70, 93, 109, 114, 144, 146

[56] References Cited

U.S. PATENT DOCUMENTS

| | | | |
|---|---|---|---|
| 2,224,103 | 12/1940 | Nilson | 272/142 X |
| 2,760,774 | 8/1956 | Perez | 272/142 X |
| 2,821,394 | 1/1958 | Barbeau | 272/127 |
| 3,068,001 | 12/1962 | Portman | 272/125 |
| 3,477,426 | 11/1969 | Wincheski | 272/142 X |
| 3,640,526 | 2/1972 | Olorenshaw | 272/143 |
| 3,707,284 | 12/1972 | Waldeck | 272/142 X |

FOREIGN PATENT DOCUMENTS

| | | | |
|---|---|---|---|
| 634093 | 12/1937 | Fed. Rep. of Germany | 272/127 |
| 2113813 | 10/1972 | Fed. Rep. of Germany | 272/135 |

*Primary Examiner*—Richard C. Pinkham
*Assistant Examiner*—William R. Browne
*Attorney, Agent, or Firm*—Robert D. Yeager

[57] ABSTRACT

A leg stretching exercise device is provided which has two platforms, each adapted to support a foot of an exerciser. Each platform is provided with ball casters which provide support and allow free movement in a mutual plane. The platforms are attached so they may be placed in touching relationship and moved apart a predetermined distance by the exerciser. A rope connects a single point on each platform. The connecting rope defines a loop which passes through eyelets, secured to each platform. An adjustable connection is provided for varying the size of the loop as desired.

7 Claims, 6 Drawing Figures

LEG STRETCHING EXERCISE DEVICE

BACKGROUND OF THE INVENTION

1. Field of the Invention

This invention relates to exercising devices and more particularly to leg stretching exercise devices.

2. Description of the Prior Art

In the pursuit of sporting physical activity, exercises are performed to enhance strength and agility, particularly for parts of the body which perform repeated functions in a particular sport. Athletes such as martial artists, dancers, gymnasts and the like require a great extension of leg muscles to properly perform in their particular field of expertise. The extensibility of the leg muscles to execute splits, kicks and the like, is enhanced by performing in their field and by special exercises designed to repeatedly stretch the leg muscles in the desired direction. One such series of exercise is called leg stretch exercises which require the exerciser, while standing, to move his feet apart, while being stiff legged, to maximum separation of his feet. This separation is accomplished with both the feet in the same plane as the body and also in a plane perpendicular to the body.

In the leg stretching exercises, the feet are to be slid across the floor from a touching position to the point of maximum separation capable of the exerciser. As the exerciser performs the leg stretching exercises on a regular basis, he is able to extend his feet further apart and finally accomplishes a split.

The performance of the leg stretching exercises is difficult in the first instance, and is made even more difficult to perform depending upon the surface which the feet must slide. For example, a surface which is too rough will cause difficulty in spreading the feet and a surface which is too smooth may cause the exerciser to lose control of his leg extension and overextend thus causing injury due to a pulled muscle.

In accordance with the present invention a leg stretching exercise device is provided which allows the exerciser to more consistently perform the exercise while maintaining control of the extent of leg stretching.

BRIEF DESCRIPTION OF THE INVENTION

A leg stretching exercise device is provided which has two platforms, each adapted to support a foot of an exerciser. Each platform is provided with means for supporting and rolling the platforms in the same plane. The platforms are attached so they may be placed in touching relationship and spaced apart by a predetermined distance. Means are also provided for adjusting the attaching means to predetermine the distance.

DETAILED DESCRIPTION OF THE DRAWINGS

Figure 1:
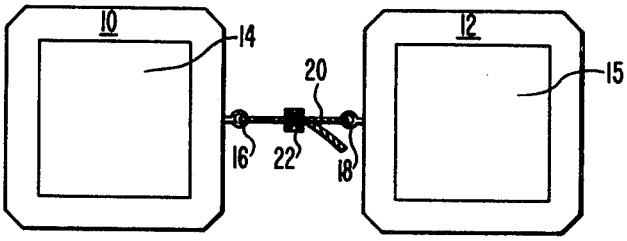
FIG. 1 is a top view of the exercising device of the invention.
Figure 2:
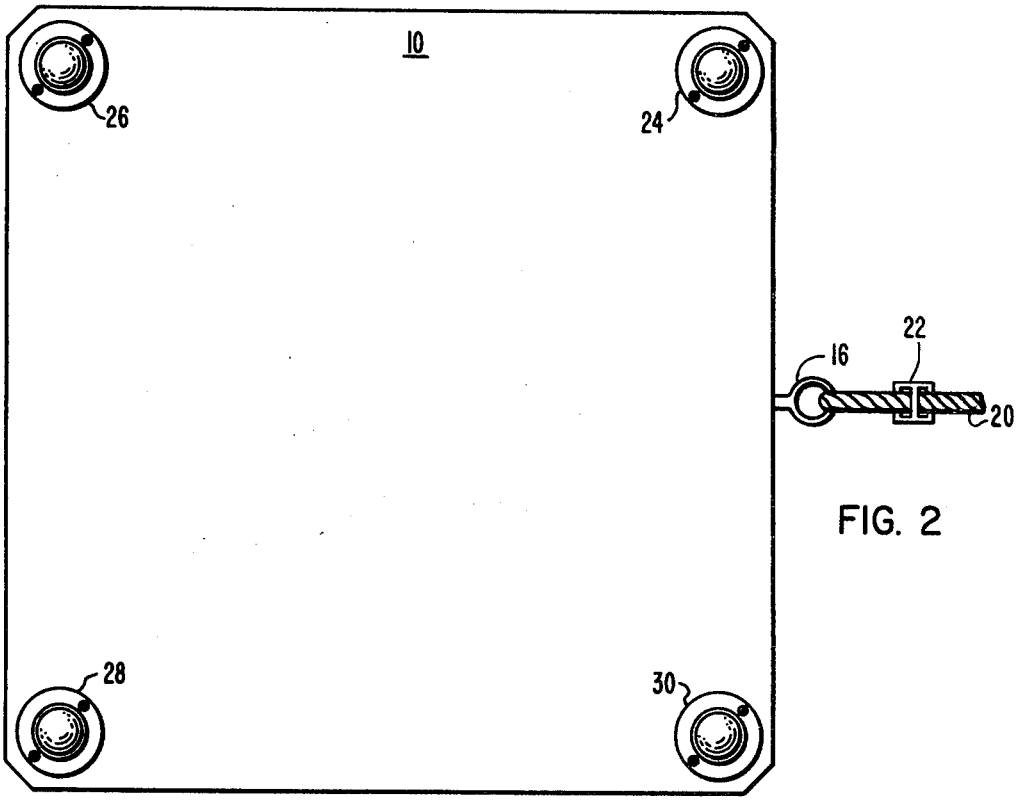
FIG. 2 is a bottom view of one platform of the exercising device.
Figure 3:
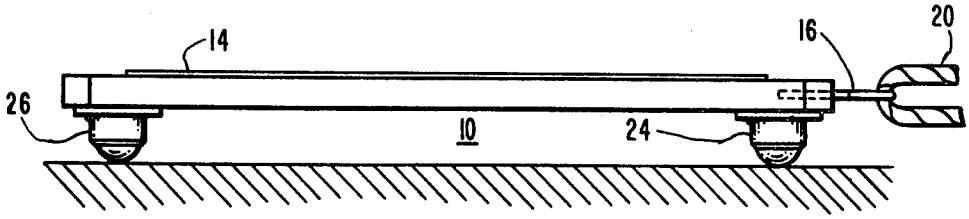
FIG. 3 is a side view of the platform of FIG. 2 shown in contact with a floor.
Figure 4:
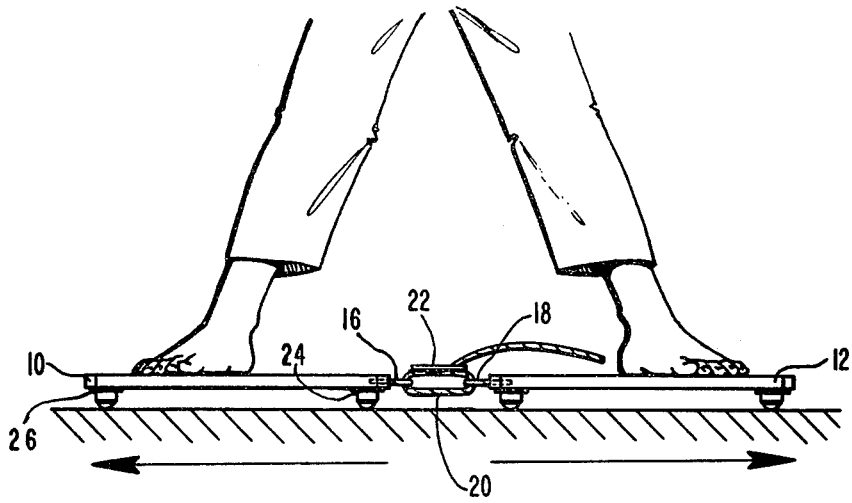
FIG. 4 is a side view of an exerciser using the exercise device of the invention.

In the description of the drawings like reference numerals refer to like parts in the various figures.

Two platforms 10 and 12 are constructed of a rigid material such as wood, plastic, metal or the like. Each platform 10 and 12 is fitted with a mat 14 and 15 which provides a skid resistant surface for adequate frictional engagement of the exercisers feet with the platforms 10 and 12. The mats 14 and 16 may be constructed of rubber, vinyl or the like with a highly textured finish and are glued to the platforms 10 and 12. In the absence of the mats 14 and 15 the surface of the platforms 10 and 12 may be textured to provide the proper frictional engagement.

Eyelets 16 and 18 are fixedly mounted to each platform in the center of one side thereof and rope 20 is threaded through the eyelets 16 and 18. Fastener 22 attaches the ends of rope 20 and fixes the maximum separation of the platforms 10 and 12. The distance of maximum separation between the platforms 10 and 12 may be adjusted by threading more or less rope through the fastener 22.

On the bottom of each platform are four ball and socket casters, 24, 26, 28 and 30. The castes are positioned on the platform at the corners thereof to provide maximum stability to the platform and to maintain the two platforms in a single plane.

Figure 5:
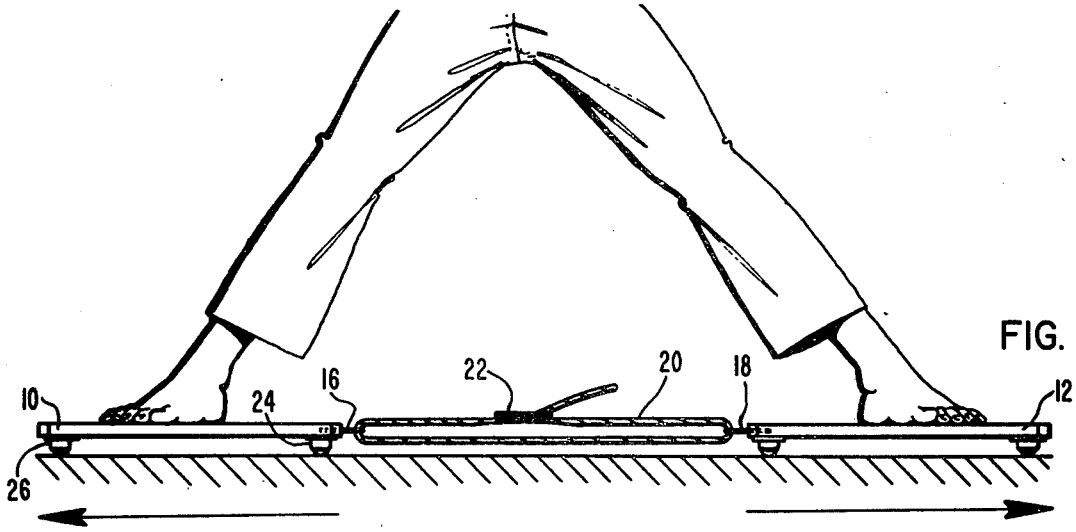
FIG. 5 is a side view of an exerciser using the exercise device of the invention when the platforms are spaced apart by a predetermined distance; and, FIG. 6 is the exerciser using the device shown in FIG. 5 when the adjusting means are relaxed.
Figure 6:
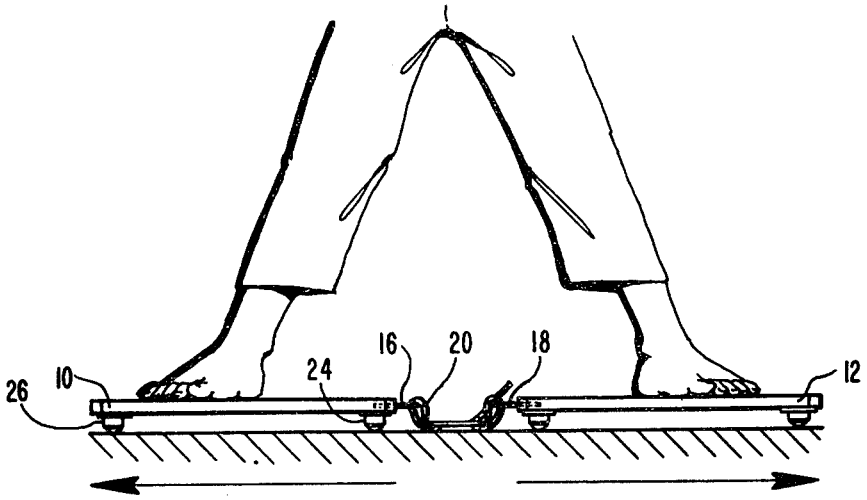

In operation as is shown in FIGS. 5 and 6, the exerciser places a foot on each of the two platform mats 14 and 15 while the platforms are in close proximity or touching relationship. The exerciser then spreads his feet apart to the maximum distance allowed by rope 20 as determined by the position of fastener 22.

The platforms 10 and 12 respond to the movement of the exerciser and the casters 24, 26, 28 and 30 slide the platform along the floor. If the exerciser wishes to stretch even further he may increase the rope length by repositioning the fastener 22. If the exerciser determines that the distance of platform separation is too large, he may then reposition the fastener 22 to obtain the desired separation.

After establishing the distance of desired maximum separation of the platforms 10 and 12, the exerciser repeatedly brings the platforms together and separates them to perform the exercise.

The exercising device in accordance with the invention enhances the efficiency of the leg stretching exercises while reducing the risk of inadvertent overextension.

As can be appreciated by those skilled in the art, substantial variations of the exercising device may be made, however the invention is only to be limited as is set forth in the accompanying claims.

What is claimed is:

1. A leg stretching exercise device for use on a floor comprising:

a pair of platform means, each said platform means adapted to support a foot of an exerciser on the upper surface of each of said platform; means during an exercise program means for independently rollingly supporting each said platform means on a floor, and permitting the pair of platform means to move freely in any direction on a floor;

non-rigid means which is non-rigid and non-electric for connecting said platforms whereby said pair of platform means may be placed in touching relationship and moved apart under the operation of a user's legs, and each platform means of said pair of platform means being freely moved in any direction upon a floor; and, means for adjusting said connecting means to limit the spaced apart distance that each platform means of said pair of platform means may be moved.

2. The exercise device of claim 1 wherein said means for rollingly supporting comprises:

at least four casters attached to the under side of each platform of said pair of platform means said platform.

3. The exercise device of claim 1 wherein said non-rigid means for attaching each said platform means of said pair of platform means comprises:

an eyelet connected to each said platform means;

a rope passing through the eyelet connected to each said platform means and being joined together to define a loop by said means for adjusting.

4. The exercise device of claim 1 including a skid resistant surface on the upper surface of each said platform means.

5. A leg stretching device for use on a hard floor comprising:

a pair of flat platform means each adapted to receive one foot of an exerciser during an exercise program;

roller suppport means attached to the bottom of each platform means of said pair of flat platform means spacing them apart from the floor and permitting independent free movement of each said flat platform means in any direction on a floor;

connecting means providing the only connection between said pair of flat platform means for non-rigidly connecting a point on one of said pair of platform means to a point on the other platform means of said pair of platform means permitting said pair of platform means to be separated by a selected distance; and, adjusting means formed integrally with said connecting means for adjusting the selected distance to which said pair of platform means may be separated by a user's legs during an exercise program.

6. A leg stretching device as claimed in claim 5 wherein:

each platform means of said pair of platform means is substantially square;

said roller suppport means comprises four ball rollers one connected in proximity to each corner of the associated platform means; and each said platform means comprising, a skid resistance surface formed on the upper surface of each said platform means of said pair of platform means.

7. A leg stretching device as claimed in claim 6 wherein said connecting means comprises:

a pair of eyelets one connected to each said platform means; and, a rope passing through said pair of outlets and being connected together by said adjusting means to define a loop.

* * * * *